US010079009B2

(12) United States Patent
Efrati

(10) Patent No.: US 10,079,009 B2
(45) Date of Patent: Sep. 18, 2018

(54) SYSTEM FOR PROVIDING VIBRATIONS REMOTELY FROM A VIBRATING TRANSDUCER

(71) Applicant: WOOJER LTD., Elad (IL)

(72) Inventor: Mor Efrati, Givat Yishayahu (IL)

( * ) Notice: Subject to any disclaimer, the term of this patent is extended or adjusted under 35 U.S.C. 154(b) by 0 days.

(21) Appl. No.: 15/552,428

(22) PCT Filed: Mar. 6, 2016

(86) PCT No.: PCT/IL2016/050251
§ 371 (c)(1),
(2) Date: Aug. 21, 2017

(87) PCT Pub. No.: WO2016/147170
PCT Pub. Date: Sep. 22, 2016

(65) Prior Publication Data

US 2018/0047376 A1 Feb. 15, 2018

Related U.S. Application Data

(60) Provisional application No. 62/132,637, filed on Mar. 13, 2015.

(51) Int. Cl.

| | |
|---|---|
| ***G08B 3/00*** | (2006.01) |
| ***G10K 9/13*** | (2006.01) |
| ***H04R 9/18*** | (2006.01) |
| ***G10K 9/22*** | (2006.01) |
| ***H04R 9/02*** | (2006.01) |

(52) U.S. Cl.
CPC ..... *G10K 9/13* (2013.01); *G10K 9/22* (2013.01); *H04R 9/025* (2013.01); *H04R 9/18* (2013.01)

(58) Field of Classification Search
None
See application file for complete search history.

(56) References Cited

U.S. PATENT DOCUMENTS

| | | | | |
|---|---|---|---|---|
| 6,137,889 | A * | 10/2000 | Shennib | H04R 25/456 181/130 |
| 2007/0036381 | A1 | 2/2007 | Klemenz | |
| 2013/0116497 | A1* | 5/2013 | Vermeiren | H04R 25/606 600/25 |
| 2014/0373701 | A1* | 12/2014 | Yaron | G10H 3/143 84/726 |
| 2015/0264494 | A1* | 9/2015 | Cho | H04R 25/606 600/25 |
| 2016/0027422 | A1* | 1/2016 | Baker | G10H 3/22 84/726 |
| 2017/0034612 | A1* | 2/2017 | Timothy | H04R 1/10 |

FOREIGN PATENT DOCUMENTS

| | | | |
|---|---|---|---|
| WO | WO 2008143573 | 11/2008 | |
| WO | WO 2012028973 | 3/2012 | |
| WO | WO 2017196945 A1 * | 11/2017 | G01H 11/02 |

* cited by examiner

*Primary Examiner* — Julie Lieu
(74) *Attorney, Agent, or Firm* — Robert G. Lev

(57) ABSTRACT

A system and corresponding method for providing mechanical vibrations at a distance from a vibrating transducer, the system for coupling to a housing of the vibrating transducer and comprising: at least one remote vibrating unit that comprises vibration pads operatively coupled by a vibration conducting element to the vibration transducer with a selectively switchable connector in the path between the vibration pad and the transducer, to selectively disconnect the vibration conducting element.

23 Claims, 7 Drawing Sheets

SYSTEM FOR PROVIDING VIBRATIONS REMOTELY FROM A VIBRATING TRANSDUCER

PRIORITY INFORMATION

The present application claims priority as a National Stage Entry of PCT/IL2016/050251, filed on Mar. 6, 2016. The present invention also claims priority to U.S. Provisional Patent Application No. 62/132,637, filed on Mar. 13, 2015.

BACKGROUND

Animals sense vibrations, mostly via the ear. The human ear is able to sense vibrations over a wide range of frequencies as audible sound.

In the audible range, acoustic vibrations are experienced as sounds. Quality speakers are required for quality reproduction of music. To provide audible sensations in the low bass, very large speakers are required. Personal earphones are not effective in providing deep notes in the bass section of the audible spectrum i.e. in the range of <250 Hz. The bass signals are only weakly picked up via the earphones, and this is one reason why people tend to listen to music via earphones at high volume, which is generally damaging to the ears. In a concert hall, some of the bass is sensed via the feet picking up vibrations of the floor, and the body sensing vibrations of the seat.

Similarly, to enable individuals to experience bass, for example, when listening to a DVD, an MP3, MP4 or smart-phone via earphones, mechanical vibrators may be attached to the body. Preferred locations are on acoustic meridians, such as near the sternum and the base of the spine, or on the legs or feet. This can provide sensations that are felt rather than heard, and which can provide or contribute to an immersive effect, particularly when provided with and synchronized with audible and visible sensations via earphones and screens. Thus, music, electronic games and movies may be enhanced by providing low frequency signals to the body.

Electromechanical vibrators that are capable of providing low frequency vibrations may comprise eccentric motors or pistons that consist of solenoid and magnets that are attracted and repelled by alternating currents in the solenoid.

In previously submitted patent applications, WO 2012/028973 "Personal Media Playing System" and WO 2012/029009 titled "A Wearable Vibration Device" a vibration device and its use for enhancing the experience of media was discussed.

The device was used for receiving low frequency electronic signals and for generating low frequency vibrations, particularly for enhancing the enjoyment of music, games and movies to a wearer.

The device, may be pinned to the body, and can oscillate at low frequencies to provide low frequency vibrations that provide a sensation of base signals. The signals are sensed where the device is positioned. If the device is placed on a rigid base, the vibrations may be felt anywhere on that base. If attached to a flexible fabric such as to an article of clothing, the signals are generally damped and only felt in the immediate vicinity of the device, which generally needs to be held against the body.

High quality vibrating devices capable of providing large amplitude vibrations over a range of frequencies are expensive. Sometimes, there is a desire to provide signals selectively to different locations. However, each single high quality vibrating transducer is expensive.

SUMMARY OF THE INVENTION

A first aspect is directed to a system for providing mechanical vibrations at a distance from a vibrating transducer, the system for coupling to a housing of the vibrating transducer and comprising:

at least one remote vibrating unit, said remote vibrating unit comprises vibration pads operatively coupled by a vibration conducting element to the vibration transducer with a selectively switchable connector in the path between the vibration pad and the transducer, to selectively disconnect the vibration conducting element.

Typically, the vibration conductor element is a wire.

Optionally, the vibration conductor element is selected from the group comprising a guitar wire or a piano wire.

In some embodiments, the wire passed through the air or through the weave of a fabric.

In some embodiments, the switchable connector comprises a metallic bar slidably inserted into a solenoid coil and a spring configured to hold the metallic bar in a position such that vibrations are not transferred, whereas applying a signal to the solenoid forces the metallic bar to a closed system such that vibrations are transmitted from the transducer to the vibration pad.

In some embodiments, the switchable connector is attached in a location selected from the group comprising:

(i) an end of the vibration conductor element and the transducer housing;

(ii) an end of the vibration conductor element and the vibration pad, and (iii) two sections of vibration conductor elements arranged in series around the switchable conductor.

In some embodiments, the switchable connector is mounted on a shock absorbing material so that the signal that can pass across the open switchable connector is highly attenuated.

In some embodiments, the vibrating transducer is tunable to provide vibrations over a range of frequencies.

In some embodiments, the vibrating transducer comprises a substantially symmetrical trapezoidal metallic frame with rounded corners of large diameter and a pair of magnets fixedly coupled to one parallel side and a coil attached to an opposite parallel side such that the axis of symmetry of the coil lies on the axis of symmetry of the trapezoidal frame, such that an electrical signal applied to the coil causes the magnets to be displaced perpendicular to the axis of symmetry, and such that the trapezoidal frame vibrates in its plane.

Typically, the vibrating transducer the metallic frame of the vibrator comprises steel.

In some embodiments, the metallic frame of the vibrator has constant thickness and a width that is constant in the parallel sides but which varies along both non-parallel sides.

In some embodiments, the non-parallel sides have widths that vary smoothly and are narrow waisted.

In some embodiments, the transducer is able to vibrate with high amplitude of vibration over a range of base frequencies.

In some embodiments, the transducer is configured to vibrate with high amplitude of vibration over a range of ultra-low frequencies.

In some embodiments, the transducer is configured to provide forced feedback when a signal with a non symmetrical waveform is provided to give provide a sensation of directionality.

In some embodiments, the transducer is couplable to a signal generator.

In some embodiments, the transducer is couplable to a power supply.

In some embodiments, the transducer is powered by battery cells.

In some embodiments, the at least one vibration pad is attachable to a location on a subject to provide a local vibratory stimulus.

In some embodiments, the at least one vibration pad is insertable into a body cavity.

In some embodiments, a vibration may be switched from one vibrating pad to another so that a sensation is moved from one location to another.

In some embodiments, the vibrating pad has sufficient momentum that, without applying a vibration, it stops vibrating very quickly.

BRIEF DESCRIPTION OF FIGURES

For a better understanding of the invention and to show how it may be carried into effect, reference will now be made, purely by way of example, to the accompanying drawings.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention; the description taken with the drawings making apparent to those skilled in the art how the several forms of the invention may be embodied in practice. In the accompanying drawings.

DESCRIPTION OF EMBODIMENTS

It is an object of preferred embodiments, to provide low frequency tactile sensations to a person.

In some embodiments, the tactile sensations are provided together with audible and visual sensations to provide an immersive experience.

Very low vibrations of below about 20 Hz, known as infrasound cannot be heard by the ears, or consciously detected but may be sensed subconsciously. There is a great deal of evidence that they are sensed by the body, and may be responsible for feelings of uneasiness or anxiety.

Earthquakes generate infrasound. Such low frequency vibrations have been found to provide feelings of anxiety and stress. Haunted houses and paranormal phenomena have been attributed to such low frequency vibrations.

Substantially sinusoidal infrasonic vibrations have been found to affect the mood of the person. Where such signals are provided together with appropriate audible and visual stimuli, specific feelings such as tension, uneasiness and anxiety are felt.

Appropriate low frequency signals may enhance the feeling of suspense when watching a movie scene depicting horror, suspense, or haunting, and provides an additional level of sensory perception to the audible and visual stimuli.

Earthquakes generate infrasound. Such low frequency vibrations have been found to provide feelings of anxiety and stress. Haunted houses and paranormal phenomena have been attributed to such low frequency vibrations.

It has surprisingly been found that a mechanical transducer comprising a solenoid coil coupled by a steel band to a magnetic array such that the magnets are arranged around the axis of the coil and separated slightly from the coil, is able to convert very low frequency electrical signals into a sideways movement of the magnetic array with respect to the axis of the coil.

Where the transducer is attached to a person via a strap around a body part, such as a belt or necklace, or is attached via a clip to a person's garments, movement of the transducer is felt by the wearer.

It will be noted that such low frequency vibrations may be detected and felt through a single transducer located in a single location. However, preferably the same or slightly different signals are applied to both wrists or to both feet or to a transducer on the back, with a second transducer on the chest, to reinforce the effect.

One way to achieve this is to apply a plurality of transducers, one in each location of interest. However, quality transducers are expensive.

The present invention addresses this by providing a system that includes a single transducer that is configured to stimulate a number of separate locations on a subject.

Figure 1:
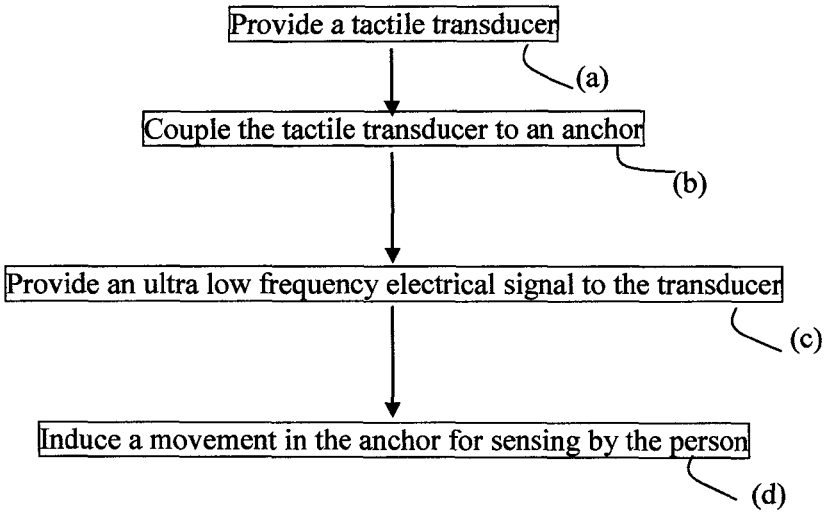
PRIOR ART Fig. 1
FIG. 1 is a flowchart of a method in accordance with one embodiment of the invention.

With reference to FIG. 1, a method of providing a personal experience to a person comprising the steps of: (a) providing a tactile transducer; (b) coupling the tactile transducer to an anchor; (c) providing an ultra low frequency electrical signal to the vibrating transducer, and (d) inducing a vibration in the anchor for sensing by the person.

Figure 2:
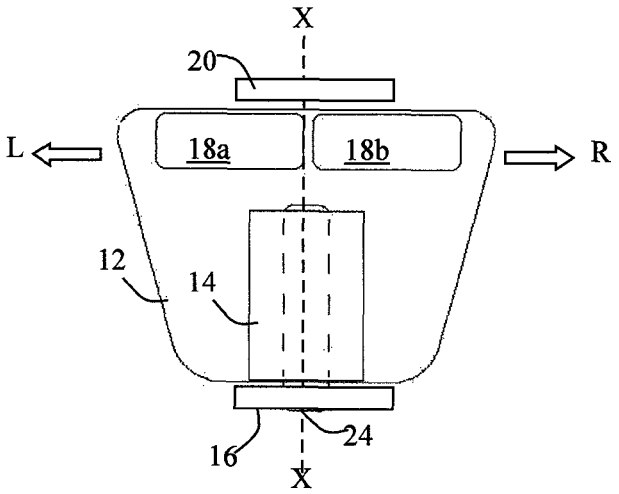
PRIOR ART Fig. 2
FIG. 2 is a schematic illustration of a tactile transducer in accordance with an embodiment of the invention.

With reference to FIG. 2, in one embodiment, the tactile transducer 10 comprises a closed loop of steel 12, a solenoid 14 coupled to the closed loop 12 at a proximal end stiffened with a proximal stiffening plate 16, and a magnetic array 18 coupled to the closed loop 12 attached a distal end that is stiffened with a distal plate 20 opposite the solenoid 14 symmetrically arranged around the axis X-X of the solenoid 14, such that changing electrical current in the solenoid 14 causes the magnetic array 18 to move from side to side L-R along a path that is substantially tangential to the axis X-X of the solenoid 14, the closed loop 12 of steel keeping the magnets 14 separated from the solenoid, but enabling them to vibrate from side to side.

In one embodiment, the magnetic array 16 comprises a pair of button magnets 18*a*, 18*b* arranged so in opposite orientation so that one magnet 18*a* is arranged South. Seeking Pole facing towards the solenoid 14, and the other magnet 18*b* is arranged with the North Seeking Pole facing towards the solenoid 14. In this configuration, when an alternating current is passed through the wire around the solenoid 14, the end of the solenoid 14 facing the magnetic array 18 is alternately magnetized North seeking and South seeking (in accordance with the right hand grip rule). Where the upper face 15 is magnetized North seeking, the South seeking face of the magnet 18*a* is attracted and the north seeking face of the magnet 18*b* is repelled and the distal end of the transducer 10 is shifted to the right, the flexibility of the loop 12 enabling the side to side movement, but preventing the magnets from moving closer to or away from the solenoid 14. Conversely, when the upper face 15 is magnetized South seeking, the North seeking face of the magnet 18*b* is attracted and the South seeking face of the magnet 18*a* is repelled and the distal end of the transducer 10 is shifted to the left.

If the stem or anchor 22 of the transducer is attached to a garment or strapped to the body, the left and right shifts may be felt by the body through the anchor 22.

In one embodiment, the closed loop 12 comprises S1010 steel and the magnets 18 are niobium magnets. The stiffness and elasticity of the closed loop 12 serve to return the magnetic array 18 to its rest position, symmetrically arranged around the axis X-X of the solenoid 14.

Low frequency symmetrical waveforms such as sinusoidal waveforms are felt as low frequency vibrations. Where the signal has a frequency of less than about 20 the transducer may provide a sensation of mood.

Where the ultra low frequency signal is a non symmetrical signal, the movement of the tactile transducer 10 causes a tugging effect that provides a directional sensation. Thus non sinusoidal signals, such as that shown in FIG. 4 for example, or even a saw-tooth signal, can provide a directional movement to the transducer 10 that is felt as a tug.

Figure 3:
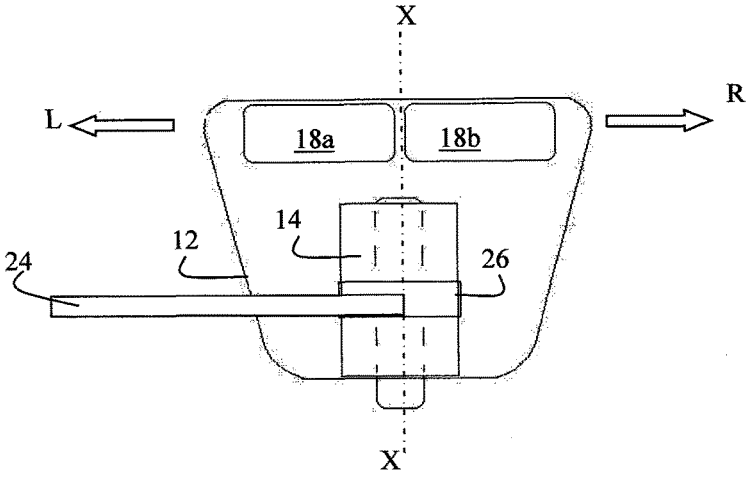
PRIOR ART Fig. 3
FIG. 3 is a schematic illustration of a tactile transducer coupled via an anchor attached near the center of gravity, in accordance with another embodiment of the invention.

With reference to FIG. 3, in a preferred embodiment, the anchor 24 is coupled to the tactile transducer 100 near to its center of mass, for example, by a non-conducting clamp 26 attached to the solenoid 14.

By attaching the anchor 24 to a central position, the directional tug created by non-symmetrical waveforms is enhanced.

In some embodiments, the tactile transducer 100 is worn on the body and provides a tactile sensation directly to the body. This is particularly effective for low frequency mood inducing sensations.

Alternatively, the tactile transducer is attached to an interface such as a seat, or to a control interface for a game console such as Nintendo's Wii, Microsoft's Xbox 360 or Sony's PlayStation 3. The control interface may be a joystick for general purpose game playing, a steering wheel or a handlebar for controlling a car or bike, a wand for playing magical fantasy games, or a platform for sensing body movements for simulating hula-hooping, skiing and similar applications.

For example, a transducer 10 (100) of the invention may be coupled to a steering wheel used for steering a vehicle in a computer game. The transducer may provide the player with a resistance to turning that can be synchronized with the virtual topography of the terrain being navigated across to provide the player with a feeling of centrifugal force, for example.

Similarly, a transducer may be attached to the handlebars of a motorbike or a water-bike of an arcade game to provide turning resistance. One or more transducers may be coupled to the footrests and/or seat of a motorbike or waterbike in an electronic arcade video game, to provide both low frequency vibrations that provide a feeling of sitting astride a powerful motor, and superimposed vibrations that are indicative of the terrain.

By providing a plurality of tactile transducers arranged at different orientations, accelerations, decelerations, left and right turns, upwards pulls, downwards pulls, forwards and backwards pulls may be created.

Furthermore, very low vibrations of below about 20 Hz, known as infrasound cannot be heard by the ears, or consciously detected but may be sensed subconsciously. There is a great deal of evidence that they are sensed by the body, and may be responsible for feelings of uneasiness or anxiety, stress, spookiness or general unease.

The transducer, whether attached to the body or to a wand, console or seat, may provide low frequency vibrations that create or enhance a mood. If the person is also exposed to audio or visual stimuli through sounds and images that are synchronized with the tactile frequency, the sensation of mood is enhanced.

For example, in a movie or game, a player may be exposed to audio or visual stimuli and to infrasonic vibrations to provide a haunted sensation. For fantasy applications, this can provide a very good immersive experience, enhancing magical experiences, for example. There are also natural phenomena that include infrasonic vibrations. These include glaciers calving icebergs, for example. It will be noted that a tiger's roar includes subsonic vibrations of about 18 Hz, which contribute to the menacing sensation that the roar induces. It will be appreciated that an infrasonic signal may be coupled with audible sound and/or images to provide an enhanced sensation of such natural phenomena and an improved immersive experience.

It will be appreciated that for movies and game applications, the tactile sensor of the invention may be combined with images projected onto a screen, onto special spectacles or onto the retina of the person, and with sounds generated via earphones or speakers. The tactile sensor may be provided as part of a console, smartphone, and the like, together with accelerometers and other tactile sensors.

The applications of low frequency and directed vibrations are not only for entertainment. It will be appreciated that low frequency vibrations to specific body parts may also provide therapeutic effects. The application of non-symmetrical signals may provide a directional stimulus that can provide a feeling or well being, and may stimulate blood circulation, relieve muscle cramps and have other beneficial effects.

Figure 4:
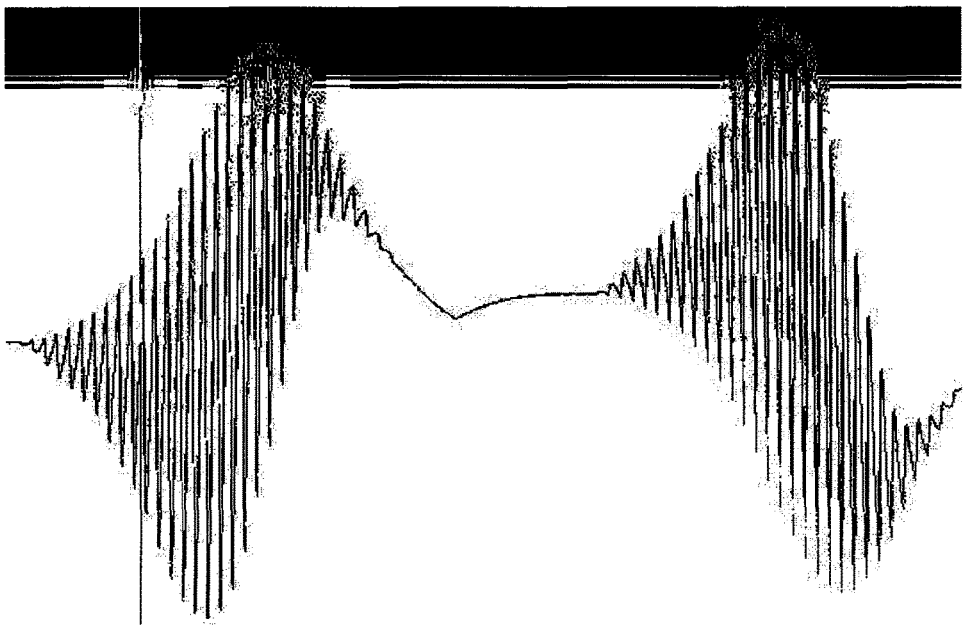
PRIOR ART Fig. 4
FIG. 4 is a specific waveform designed for the transducer of FIG. 3 for providing a directional tug.

With reference to FIG. 4, an exemplary waveform for giving a directional effect to the transducer of FIG. 3 is shown. The structure of the signal is a combination of an attack signal which is a 200 Hz sine wave with a sustain, decay & release signal that has a frequency of 50 Hz. The amplitude of the wave is +4 dB, and the release of the signal ends at a single strength of −22 dB. It will be appreciated that this wave has been developed for a specific transducer as shown in FIG. 3, and variations in the various parameters such as the number of coils of the solenoid, the size and strength of the magnets, the coefficient of elasticity and the dimensions of the band of steel 12, can all affect the shape of the optimum signal.

To understand how the signal of FIG. 4 interacts with the sensor 10 (100) of the invention, a series of simpler waves are now explained.

Figure 5:
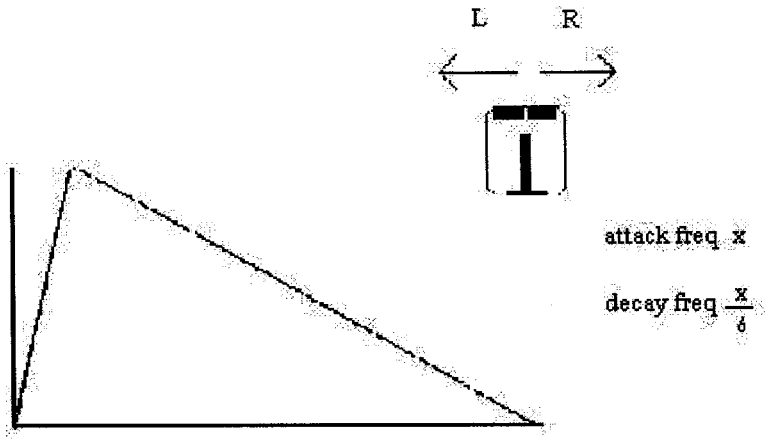
PRIOR ART Fig. 5
FIG. 5 is a triangular wave form of the prior art, with a steep attack frequency and a gentle decay frequency.

With reference to FIG. 5, a saw-toothed wave form is shown. Saw toothed wave causes a sharp tug towards the left. The decay to the right takes 6 times as long and is therefore not really felt.

Figure 6:
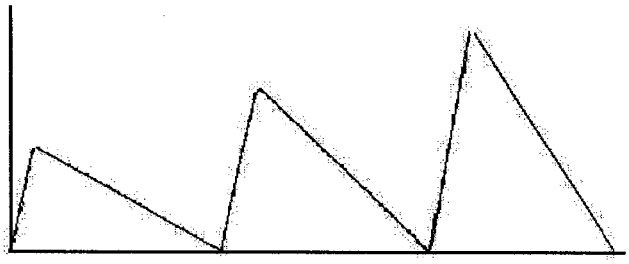
PRIOR ART Fig. 6
FIG. 6 is a series of triangular wave forms of the prior art, characterized by steep attack frequencies and gentle decay frequencies.

With reference to FIG. 6, a series of saw-toothed waveforms of FIG. 5, with gradually increasing amplitudes, provides a continuous pulling to the left, instead of a sharp tug.

Figure 7:
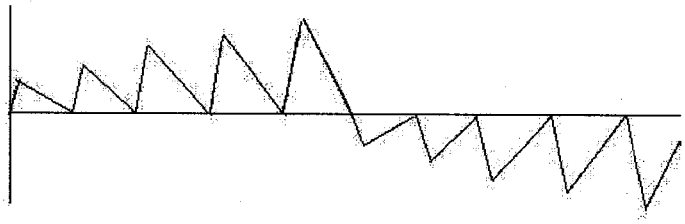
PRIOR ART Fig. 7
FIG. 7 is a series of triangular wave forms of the prior art.

FIG. 7 shows a series of saw toothed waveforms as with FIG. 6, that provides a smooth pull to the left, followed by a second series of saw-toothed waveforms having a sharp rise to the right, followed by a relatively long decay. The sensor receiving the waveform of FIG. 7 experiences a smooth pulling to the left, followed by a smooth pulling to the right.

A limitation of the transducer 10 thus far described is that it applies a signal to a specific location. To provide a quality gaming experience, or an immersive experience in music, a game or a movie, for example, it is useful to provide stimuli, whether musical or experiential, to a number of locations.

As has been previously disclosed, it is possible to provide a number of transducers 10, each in a different specific location to stimulate different parts of the body, whether worn, or whether in different parts of a console for a computer simulation, different areas of a cinema seat, and the like to provide stimuli to each hand, to the pelvis through the seat, to the back and the like.

However, doing so is expensive, particularly where the transducers are very high quality and thus costly.

Figure 8:
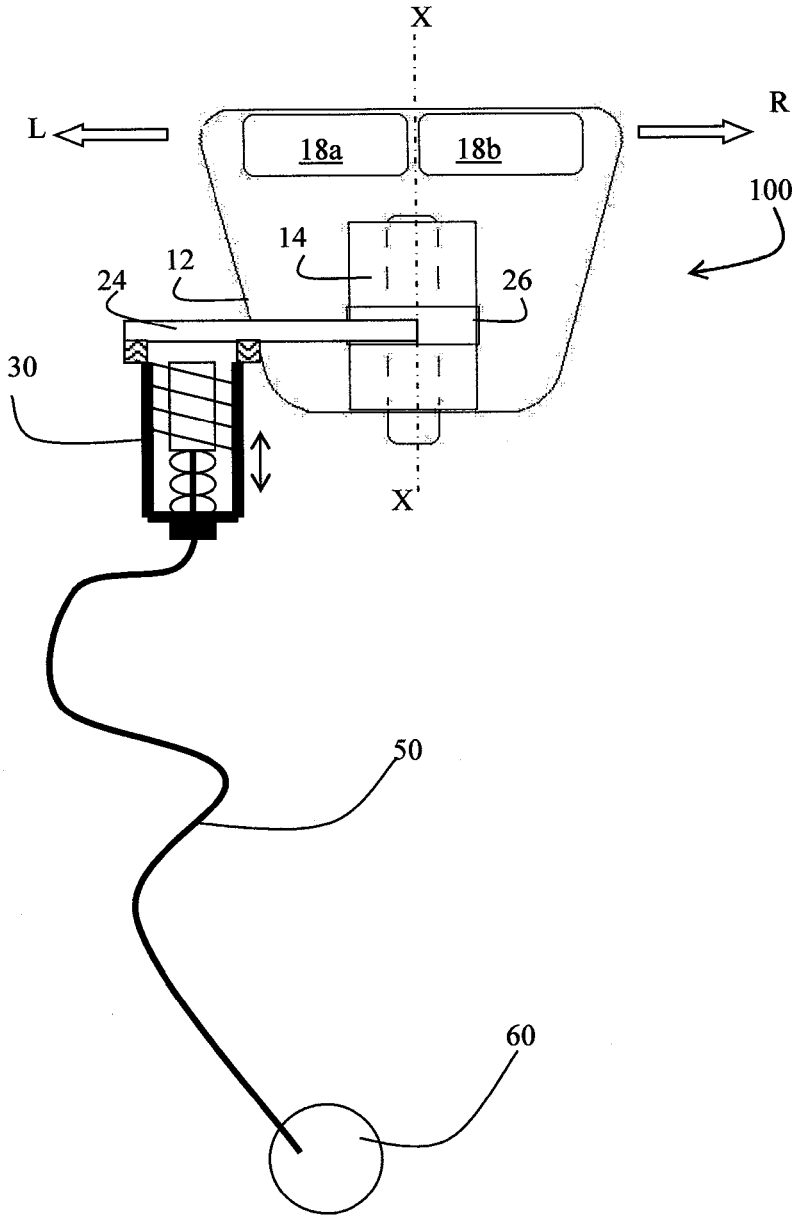
FIG. 8 is an embodiment of the invention wherein a connector is attached to a static element of a tactile transducer via a switch.

With reference to FIG. 8, a system for providing mechanical vibrations at a distance from a vibrating transducer 100 is shown. The system consists of a vibrating pad 60 that is remote from the transducer 100. The vibrating pad 60 is coupled to the transducer by a conducting element 50 that is typically a wire, such as a guitar string or piano wire. The conducting element is typically coupled to an anchor 24 coupled to the tactile transducer 100 near to its center of mass or to the housing to the vibration transducer via a selectively switchable connector 30 in the path between the vibration pad 60 and the transducer 100, to selectively disconnect the vibration conducting element.

The conducting element 50 may be run through the air or through a pipe or tube, such as the outer casing of the break cable of a bicycle. If designed to be worn, the conducting element 50 may be threaded through the fabric of a garment.

Although only one conducting element 50 coupled via one switch to one vibrating pad 60 is shown in FIG. 8, it will be appreciated that a number of such systems may be coupled to a single transducer 100 to provide stimuli to a plurality of locations.

The vibrating pad 60 is generally designed to have sufficient momentum that, without applying a vibration, it stops vibrating very quickly.

Figure 9:
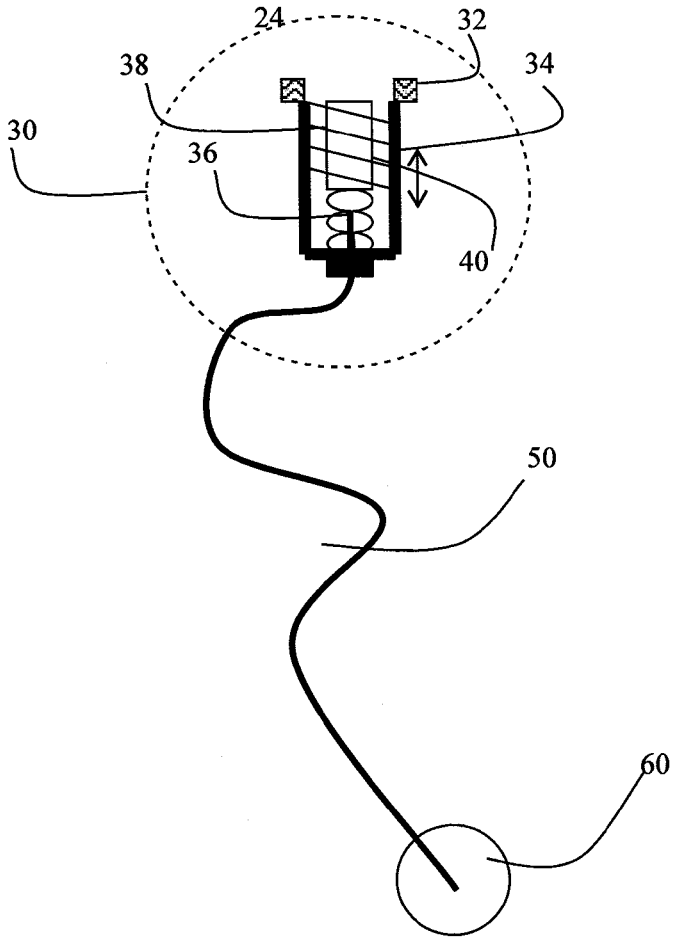
FIG. 9 shows the connector and switch in more detail.

Referring now to FIG. 9, the switchable connector 30 consists of a casing 34 and a ferrous bar 40 slidably positioned therein and able to reciprocate backwards and forwards within and driven by signals provided to a solenoid coil 38. A spring 36 is provided and configured to hold the ferrous bar 40 in a position such that vibrations are not transferred (naturally OFF), whereas applying a signal to the solenoid coil 38 forces the ferrous bar 40 to an ON position such that vibrations are transmitted from the transducer 10 via the conducting element 50 to the vibration pad 60. Shock absorbers 32 such as a rubber gasket is provided between the casing 34 and the transducer 100 so that when the switchable connector 30 is in the OFF position, vibrations are not significantly transmitted to the conducting element 50 via the casing 34. When in the ON position, the vibrations of the transducer 100 are transmitted via the ferrous bar 40, through the conducting element 50 to the vibration pad 60.

Figure 10:
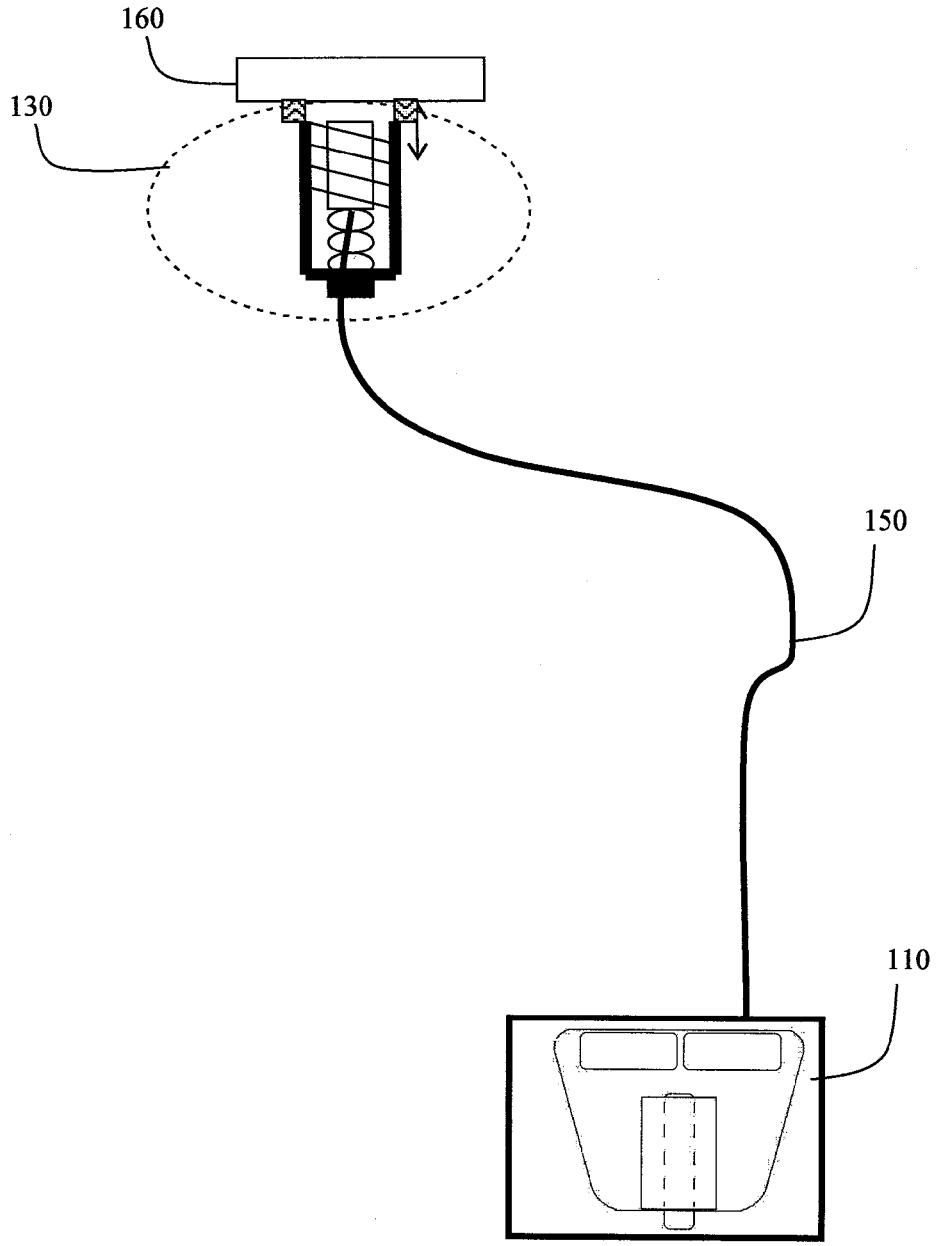
FIG. 10 shows a second embodiment, wherein the connector is attached to a case around the transducer and a switch may is configured to selectively connect and disconnect the connector to the vibration pad.

With reference to FIG. 10, in a second embodiment, the switchable connector 130 may be attached at the end of the vibration conducting element 150 between the vibration conducting element 150 and the vibration pad 160.

Figure 11:
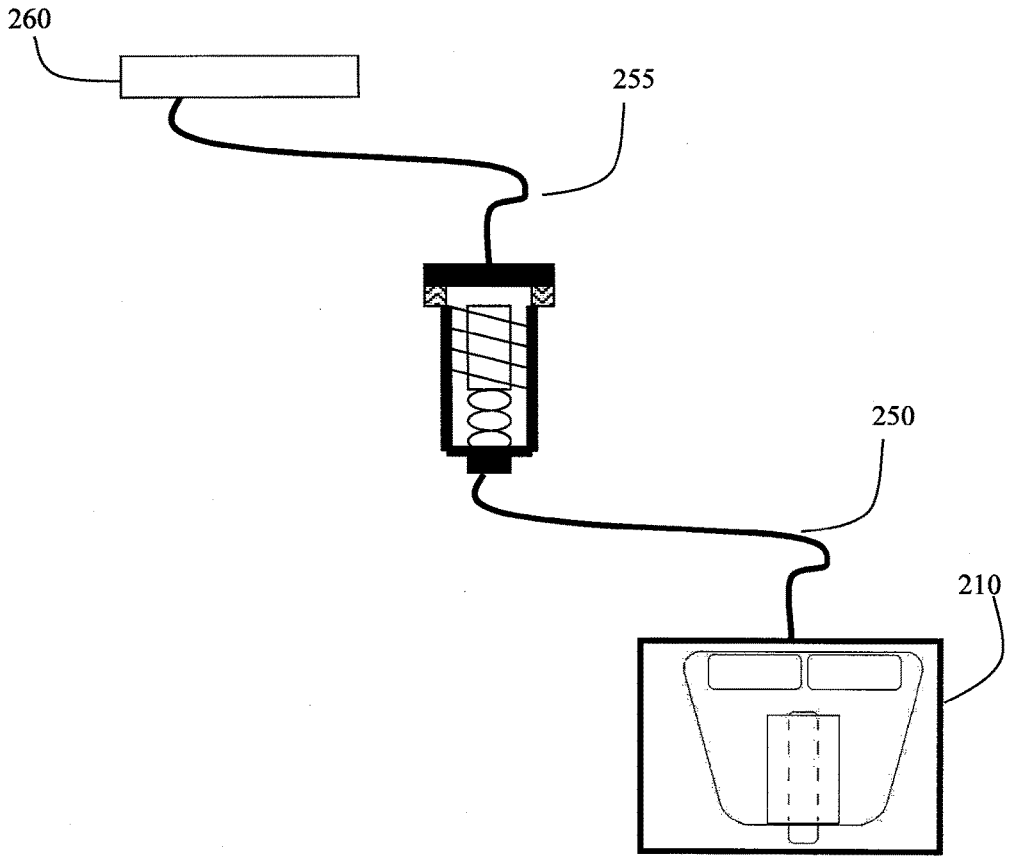
FIG. 11 shows a third embodiment wherein a first connector is attached to a case around the transducer and is coupled to a second connector via a switch that is configured to selectively connect and disconnect the two connectors, thereby selectively connecting and disconnecting a vibration pad from the vibrator.

With reference to FIG. 11, in a third embodiment, the switchable connector 230 may be attached between two sections of vibration conducting elements 250, 255, one coupled to the transducer casing 210 and the other to the vibration pad 260.

In all three embodiments, the vibration conducting elements transmit vibrations from the transducer to the vibrating pad via the switchable connector when in the ON position, and don't transmit a signal when in the OFF position, enabling the vibration pad to be selectively activated. With different vibration pads in different locations, the user experience may be enhanced.

The remote vibrating pads are designed for music and gaming enhancement, however it will be appreciated that they could alternatively or additionally be used to provide erotic stimulation to one or more locations on or in body cavities of one or more subjects.

The system of claim 1, wherein the vibrating transducer comprises a substantially symmetrical trapezoidal metallic frame with rounded corners of large diameter and a pair of magnets fixedly coupled to one parallel side and a coil attached to an opposite parallel side such that the axis of symmetry of the coil lies on the axis of symmetry of the trapezoidal frame, such that an electrical signal applied to the coil causes the magnets to be displaced perpendicular to the axis of symmetry, and such that the trapezoidal frame vibrates in its plane.

The system of claim 1, wherein the vibrating transducer the metallic frame of the vibrator comprises steel.

The system of claim 9 wherein the metallic frame of the vibrator has constant thickness and a width that is constant in the parallel sides but which varies along both non-parallel sides.

The system of claim 11, wherein the non-parallel sides have widths that vary smoothly and are narrow waisted.

The system of claim 11 wherein the transducer is able to vibrate with high amplitude of vibration over a range of base frequencies.

The system of claim 11 wherein the transducer is configured to vibrate with high amplitude of vibration over a range of ultra-low frequencies.

The system of claim 11 wherein the transducer is configured to provide forced feedback when a signal with a non symmetrical waveform is provided to provide a sensation of directionality.

With reference to FIG. 12, a method of providing vibrations from a single transducer to one or more remote locations consists of coupling a vibrating pad in each remote location via a vibration conducting element and a switchable connector to the transducer, switching the switchable connector to the ON position and applying a signal.

The transducer itself is coupled to a signal generator that provides signals to the solenoid of the transducer to create desired vibrations, which may have any of a wide variety of frequencies, amplitudes and wave forms. The transducer is couplable to a power supply or is powered by battery cells.

By supplying a signal to one vibrating pad and then to another a sensation of movement from one location to another is provided.

In some embodiments, the vibrating pad has sufficient momentum that, without applying a vibration, it stops vibrating very quickly.

The vibrations may be force feedback directional signals giving a sensation of momentum and directional force. Although particularly useful for sensing bass frequency vibrations and infra sound, the range of frequencies that may be detected is very wide, and by changing the dimensions of the transducer, it may be tailored for these and other specific ranges. Indeed, by careful selection of the components of the transducer, including the mass and magnetic power of the magnets and the dimensions and number of coils of the solenoids, each transducer may be optimized for specific purposes or special effects. Thus embodiments of this invention may be used for enhancing the audible experience, creating an immersive experience or an experience of virtual reality, for example.

Several embodiments of the present invention have been described. Nevertheless, it will be understood that various modifications may be made without departing from the spirit and scope of the invention. Accordingly, other embodiments are within the scope of the following claims.

Thus persons skilled in the art will appreciate that the present invention is not limited to what has been particularly shown and described hereinabove. Rather the scope of the present invention is defined by the appended claims and includes both combinations and sub combinations of the various features described hereinabove as well as variations and modifications thereof, which would occur to persons skilled in the art upon reading the foregoing description.

In the claims, the word "comprise", and variations thereof such as "comprises", "comprising" and the like indicate that the components listed are included, but not generally to the exclusion of other components.

The invention claimed is:

1. A system for providing mechanical vibrations at a distance from a vibrating transducer, the system for coupling to a housing of the vibrating transducer and comprising:

at least one remote vibrating unit, said remote vibrating unit comprises vibration pads operatively coupled by a vibration conducting element to the vibration transducer with a selectively switchable connector in the path between the vibration pad and the transducer, to selectively disconnect the vibration conducting element.

2. The system of claim 1 wherein the vibration conductor element is a wire.

3. The system of claim 1 wherein the vibration conductor element is selected from the group comprising a guitar wire or a piano wire.

4. The system of claim 1 wherein the vibration conductor element comprises a wire comprising a material selected from the group comprising metal, alloys, plastics and glasses.

5. The system of claim 2, wherein the wire passed through the air or through the weave of a fabric.

6. The system of claim 1 wherein the switchable connector comprises a metallic bar slidably inserted into a solenoid coil and a spring configured to hold the metallic bar in a position such that vibrations are not transferred, whereas applying a signal to the solenoid forces the metallic bar to a closed system such that vibrations are transmitted from the transducer to the vibration pad.

7. The system of claim 1 wherein the switchable connector is attached in a location selected from the group comprising:

an end of the vibration conductor element and the transducer housing;

an end of the vibration conductor element and the vibration pad, and two sections of vibration conductor elements arranged in series around the switchable conductor.

8. The system of claim 6 wherein the switchable connector is mounted on a shock absorbing material so that the signal that can pass across the open switchable connector is highly attenuated.

9. The system of claim 1 wherein the vibrating transducer is tunable to provide vibrations over a range of frequencies.

10. The system of claim 1, wherein the vibrating transducer comprises a substantially symmetrical trapezoidal metallic frame with rounded corners of large diameter and a pair of magnets fixedly coupled to one parallel side and a coil attached to an opposite parallel side such that the axis of symmetry of the coil lies on the axis of symmetry of the trapezoidal frame, such that an electrical signal applied to the coil causes the magnets to be displaced perpendicular to the axis of symmetry, and such that the trapezoidal frame vibrates in its plane.

11. The system of claim 1, wherein the vibrating transducer the metallic frame of the vibrator comprises steel.

12. The system of claim 11 wherein the metallic frame of the vibrator has constant thickness and a width that is constant in the parallel sides but which varies along both non-parallel sides.

13. The system of claim 12, wherein the non-parallel sides have widths that vary smoothly and are narrow-waisted.

14. The system of claim 12 wherein the transducer is able to vibrate with high amplitude of vibration over a range of base frequencies.

15. The system of claim 12 wherein the transducer is configured to vibrate with high amplitude of vibration over a range of ultra-low frequencies.

16. The system of claim 12 wherein the transducer is configured to provide forced feedback when a signal with a non symmetrical waveform is provided to give provide a sensation of directionality.

17. The system of claim 1, wherein the transducer is couplable to a signal generator.

18. The system of claim 1, wherein the transducer is couplable to a power supply.

19. The system of claim 1, wherein the transducer is powered by battery cells.

20. The system of claim 1 wherein said at least one vibration pad is attachable to a location on a subject to provide a local vibratory stimulus.

21. The system of claim 1 wherein said at least one vibration pad is insertable into a body cavity.

22. The system of claim 1 wherein a vibration may be switched from one vibrating pad to another so that a sensation is moved from one location to another.

23. The system of claim 1, wherein the vibrating pad has sufficient momentum that, without applying a vibration, it stops vibrating very quickly.

* * * * *